US005679080A

United States Patent [19]

Finsterwald

[11] Patent Number: 5,679,080

[45] Date of Patent: Oct. 21, 1997

[54] GOLF CLUB SWING TRAINING DEVICE

[76] Inventor: Dow H. Finsterwald, 6330 Masters Blvd., Orlando, Fla. 32819

[21] Appl. No.: 397,855

[22] Filed: Mar. 2, 1995

[51] Int. Cl.[6] ..... A63B 69/36

[52] U.S. Cl. ..... 473/206; 473/227; 473/276; 473/299

[58] Field of Search ..... 273/162 E, 162 F, 273/162 R, 194 R, 81.2; 473/206, 227, 239, 277, 276, 299

[56] References Cited

U.S. PATENT DOCUMENTS

| | | | |
|---|---|---|---|
| 4,592,204 | 6/1986 | Patterson | 273/194 R X |
| 4,595,204 | 6/1986 | Patterson | 273/194 R X |
| 4,669,726 | 6/1987 | Lempio | 273/81.2 |
| 4,687,204 | 8/1987 | Lempio | 273/162 E |
| 5,024,438 | 6/1991 | Candow | 273/81.2 X |
| 5,029,860 | 7/1991 | Ehrich | 273/81.2 |
| 5,452,891 | 9/1995 | Thomas | 273/194 R |
| 5,465,971 | 11/1995 | Tischler | 473/276 X |

*Primary Examiner*—George J. Marlo
*Attorney, Agent, or Firm*—Dorsey & Whitney LLP

[57] ABSTRACT

A grip extender for extending the length of a golf club to form a chip shot training club, wherein the golf club includes an elongated hollow tube handle defining a central axial aperture at a free end thereof opening into the interior of the tube handle along the central longitudinal axis thereof. The grip extender includes an elongated substantially hollow main body having a longitudinal axis, and an elongated rod mounted on and extending longitudinally axially from one end of the elongated main body. The rod is configured to define an initial straight length of rod and a subsequent plurality of reversing bends which are substantially symmetric relative to the central longitudinal axis of the hollow main body. The rod is insertable into the tube handle such that the reversing bends engage the tube at a plurality of longitudinally spaced locations on different sides thereof for positively supporting the grip extender on the golf club in continuous longitudinal axial alignment therewith. The grip extender main body has a plug-type connector at one end supporting the rod such that the rod extends from the main body along the central longitudinal axis of the tube handle when the extender is mounted on the golf club. The main body also has a length which extends upwardly from the free end of the club handle along the golfer's arm to approximately, but not exceeding, the position of the golfer's elbow when the golfer is conventionally gripping the golf club.

1 Claim, 3 Drawing Sheets

GOLF CLUB SWING TRAINING DEVICE

BACKGROUND OF THE INVENTION

1. Field of the Invention

The present invention relates generally to the game of golf and more specifically to a device adapted to be axially attached to a golf club to extend the length of the golf club thereby converting the club into a golf training aid.

2. Description of the Prior Art

The game of golf is one of the oldest and most complex games ever to be played by man. The swing itself while appearing in many instances to be naturally performed, has numerous intricacies which trained professionals understand and try to impart to the numerous students of the game.

To assist a student in developing a proper swing and understanding the numerous intricacies therein, many training aids have been developed. Most training aids are adapted to guide the golfer's swing or are adapted to be attached to the golfer's body to inhibit or encourage certain body movements. Other training aids are adapted to be placed on the ground adjacent to the golf ball to be hit and either guide the golfer in properly moving the golf club head through the ball or in some instances actually record club head speed at impact with the ball as well as other variations which may impart spin to the ball.

Most golf training aids do not constitute attachments to a golf club itself even though such aids do exist. An example of such is disclosed in U.S. Pat. No. 4,595,204 issued to Patterson on Jun. 17, 1986. In the Patterson patent, an extension to the golf club is disclosed which consists of hollow plastic tubing approximately the same width as the butt end of the golf club shaft and having a socket adapted to extend over the butt end of the golf club. An axially extending pin is positioned internally of the socket and adapted to be inserted into the relatively small vent hole found in the end of most golf club grips so as to center the extension on the shaft. The socket is clamped onto the butt end of the golf club to releasably hold the extension on the club. The device was designed to assist a golfer in developing a proper swing for long golf shots where a full swing of the golf club is required.

Similar extensions have recently been developed with the increased interest in relatively long putter shafts. It has been found that by providing a long shaft on a putter many golfer who otherwise suffer from nervous twitches in their putting stroke can overcome such nervous disorders by using a long putter shaft which can be anchored against the golfer's body in an upper torso region. Examples of extensions for putters which are removably attached to make them easily transportable, particularly when on airlines, are disclosed in U.S. Pat. No. 5,024,438 issued to Candow on Jun. 18, 1991 and U.S. Pat. No. 5,029,860 issued to Ehrich on Jul. 9, 1991. The Candow device includes a hollow rod adapted to be inserted into the open butt end of a putter shaft, but in order to insert the hollow rod into the putter shaft, the end of the grip on the putter has to be cut out or enlarged so that the opening in the end of the grip is approximately the same diameter as the hollow putter shaft. This leaves the putter undesirably maimed when the extension is removed.

The Ehrich device is a telescoping extension device which is externally fitted over the shaft of a putter so as to make the modified putter shaft adjustable in length by telescopically moving the elements of the extension.

While extensions to golf clubs can convert the club into a useful and meaningful training aid, the extensions disclosed in the prior art are relatively expensive and complex and/or require modification to the golf club itself so as to destroy the natural characteristics of the club when the extension is removed.

It is to overcome the aforenoted shortcomings in the prior art that the device of the present invention was developed.

SUMMARY OF THE INVENTION

The device of the present invention consists of an extender for golf clubs adapted to extend the length of the club approximately one to two feet so that the club becomes useful in developing a proper chipping stroke.

The device includes a main body of approximately the same diameter as the butt end of the golf club and an axially extending insert. The insert is a resilient rod that is serpentine or sinusoidal configuration and having a diameter substantially the same as the diameter of the vent hole in the butt end of a golf club grip. The serpentine configuration of the insert and its small diameter allow it to be inserted through the vent hole conventionally found in golf club grips until it is fully inserted into the hollow butt end of the shaft. The serpentine configuration of the insert allows the insert to frictionally engage and be spring biased against the internal wall of the shaft. When the insert is fully inserted into the golf club shaft, the main body of the device forms a contiguous, axial extension from the golf club allowing the golf club and the extender device to move unitarily.

For reasons that will become more clear with the detailed description of the invention that follows, the extender from the golf club provides a convenient means for developing a desired chipping stroke.

Other aspects, features and details of the present invention can be more completely understood by referring to the following detailed description of a preferred embodiment, taken in conjunction with the drawings, and the appended claims.

DESCRIPTION OF THE PREFERRED EMBODIMENT

Figures 1, 2:
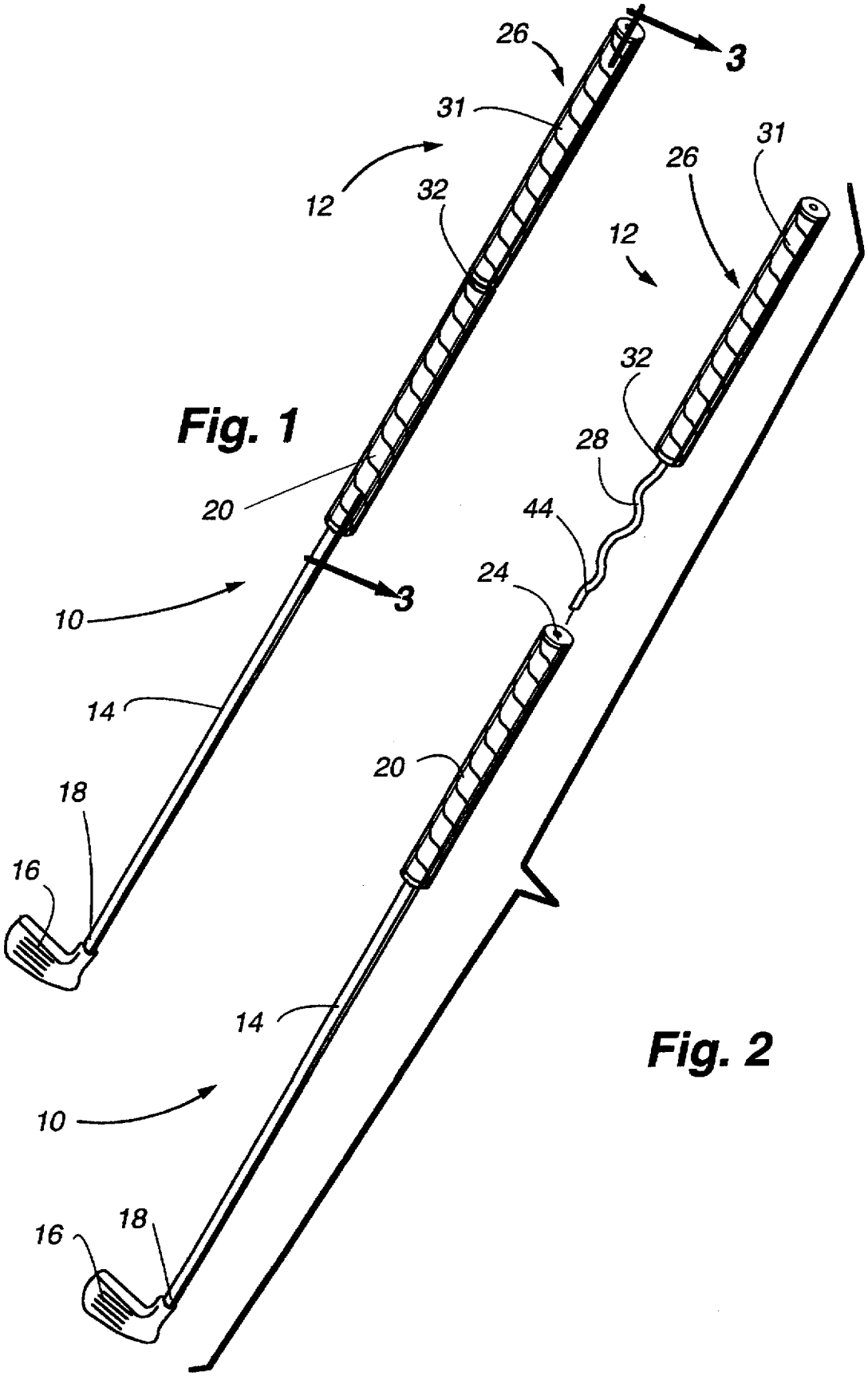
FIG. 1 is an isometric view of a golf club having the extender device of the present invention affixed thereto.
FIG. 2 is an exploded isometric view similar to FIG. 1 showing the device of the present invention in a position prior to insertion or attachment to a golf club.

A conventional golf club 10 to which the extender device 12 of the present invention is adapted to be attached can best be seen in FIG. 2. The club 10 has an elongated hollow shaft 14 with a club head 16 secured at the tip end 18 of the shaft and a grip 20 overlying the butt end 22 of the shaft. The grip could be of the leather type that are wrapped around the butt end of the shaft or of the more commonly found rubber or synthetic type that are merely slid onto the butt end of the shaft and frictionally retained thereon. Particularly with the latter type of grip, the grip typically includes a vent hole 24 in its butt end so as to permit the grip to be advanced onto the shaft while allowing entrapped air to escape through the vent hole.

Figure 3:
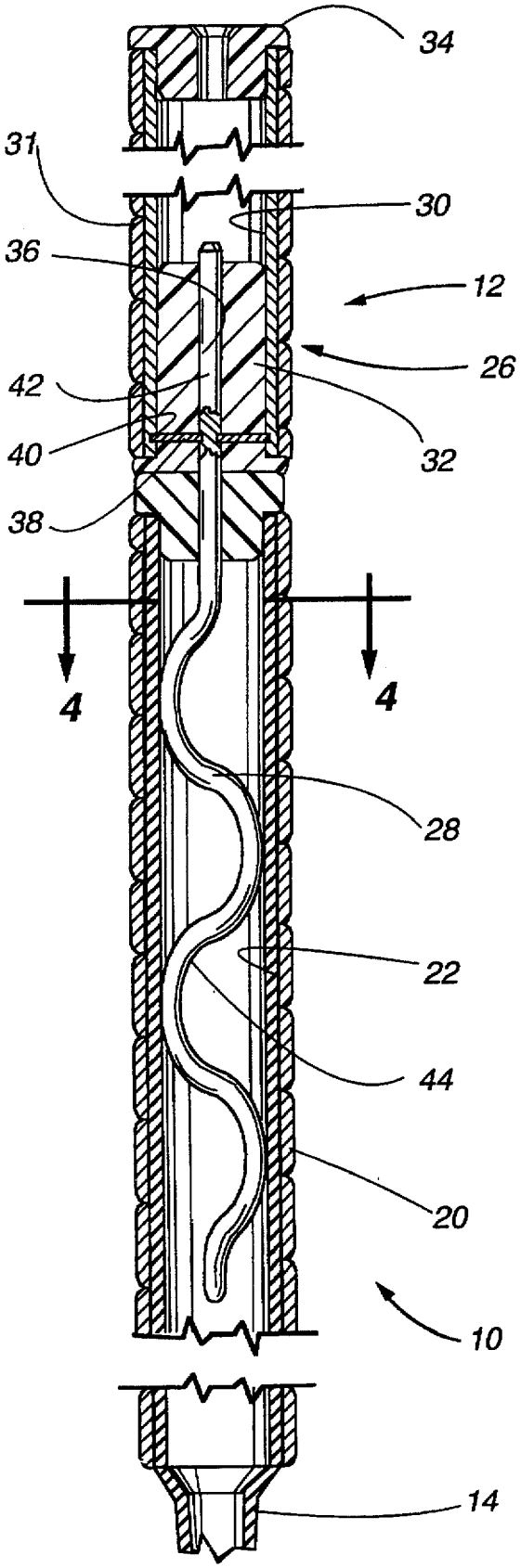
FIG. 3 is an enlarged longitudinal section taken along line 3—3 of FIG. 1.
Figure 4:
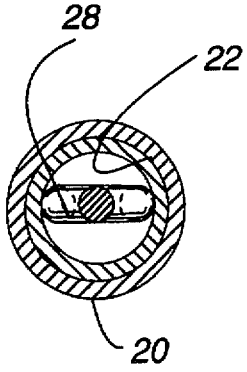
FIG. 4 is a transverse section taken along line 4—4 of FIG. 3.

The extender device 12 is probably best seen in FIGS. 1, 2 and 3. It includes a main body 26 and an insert 28 extending axially from the main body. The main body can comprise a hollow tubular shaft 30 identical to or similar to that of the golf club itself having its own grip 31 that may be identical to the grip 20 on the golf club shaft. A plug 32 is compressively inserted in one end of the shaft 30 and serves as a connector or anchor for the insert 28. A closure cap 34 is frictionally retained in the outer end of the shaft 30. The shaft 30 is preferably a foot to two feet in length so that when a golfer normally grips the golf club on the golf club grip 20, the extender device 12 extends upwardly along the inside of the golfer's left arm (if the golfer is right handed) so as to extend approximately to the golfer's elbow and in alignment with the lower rib cage of the golfer. While the length of the extender does not have to be precise, an extension of the general length described is of importance for reasons to be made more clear hereafter with a description of the operation of the golf club with the extender thereon.

The connector or anchor 32 on the end of the main body is preferably a rubber plug either frictionally retained in the open inner end of the hollow tubular shaft 30 of the device or bonded therein. The plug has an axial opening 36 approximately the same diameter as the vent hole 24 in the golf club grip 20 and receives an outer end of the insert rod 28. The plug may also be secured in the inner end of the shaft with a conventional C-clip 38 (FIG. 3) received in an inwardly opening annular groove 40 at the inner end of the shaft 30.

The insert rod 28 has a relatively straight outermost end 42 that is received and either frictionally or otherwise secured in the plug 32 with a bonding medium so as to form an axial extension from the inner end of the shaft. The straight portion 42 of the insert rod is also adapted to extend through the vent hole 24 in the end of the golf club grip 20 as best seen in FIGS. 2 and 3. At the end of the straight portion 42 of the insert rod, it passes through a sinusoidally curved portion 44 so as to form a plurality of reversing bends and be serpentine in configuration with the distance from tip to trough of the sinusoidal curve being slightly greater than the internal diameter of the butt end of the golf club shaft 14.

While the insert rod can be made of any suitable material such as steel or plastic, it should have some degree of resiliency so that the serpentine configuration provides some lateral resiliency so the insert is capable of being releasably wedged internally of the golf club shaft. The serpentine configuration spring biases the insert rod against the internal wall of the golf club shaft.

As can best be seen in FIG. 3, when the insert rod 28 of the extender device 12 is fully inserted into the butt end of the golf club shaft 14, the main body 26 of the extender device forms a contiguous extension from the butt end 22 of the shaft. The wedged relationship of the insert rod with the interior of the golf club shaft solidly but releasably anchors the extender device on the golf club so that the device forms an axial extension from the club and is firmly connected for unitary movement with the golf club.

Figure 5:
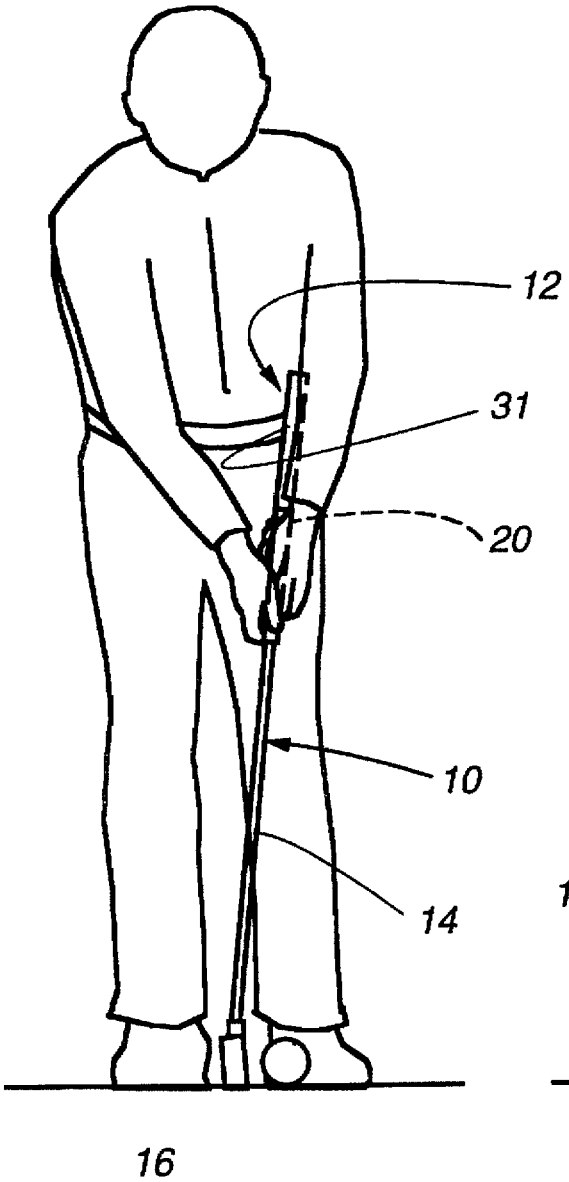
FIG. 5 is a front elevation showing a golf club having the device of the present invention attached thereto in use by a golfer.
Figure 6:
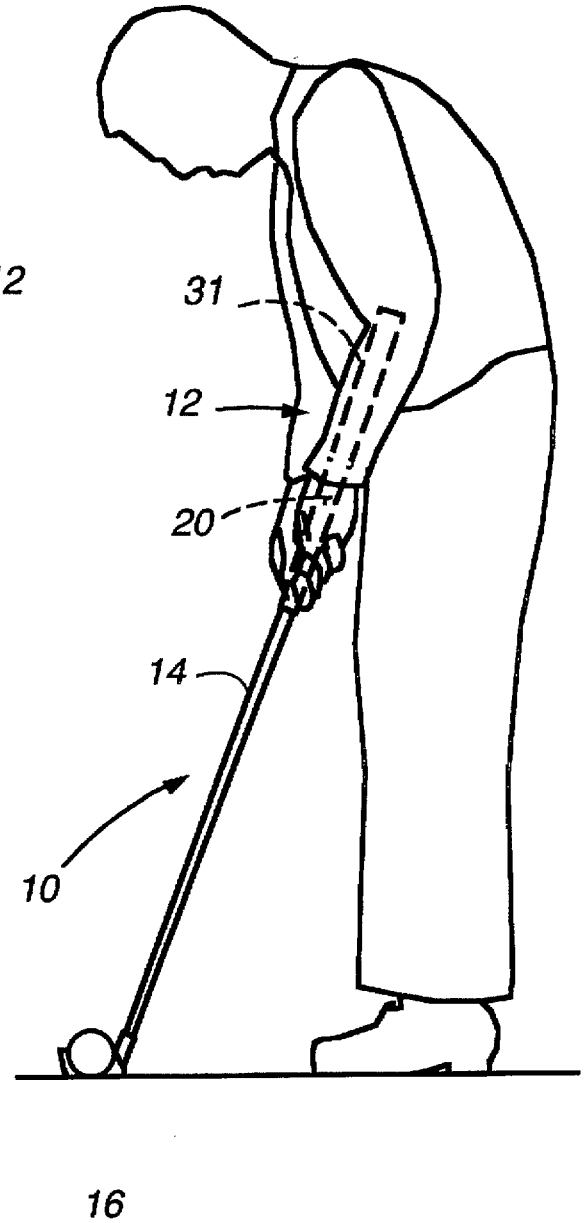
FIG. 6 is a side elevation of a golfer with the golf club as shown in FIG. 5.

With the device 12 of the present invention attached to the golf club in the manner aforedescribed, a golfer can grip the golf club in a normal manner as illustrated in FIGS. 5 and 6 so that the device extends axially upwardly along the inside of the golfer's left forearm with the terminal end of the device being positioned closely between the golfer's elbow and lower rib cage. In this position, it will be appreciated that if the golfer's wrists are broken during a stroke, the outer end of the extender device will either engage the golfer's rib cage or the inside of the left forearm, in either event indicating to the golfer that the wrists have undesirably broken.

The device is therefore useful in training a golfer to immobilize the wrists during a chipping stroke similar to that desired in a putting stroke.

It will be appreciated from the above that the extender device of the present invention is very simple and inexpensive to manufacture while forming a rigid releasable extension from a golf club. The extension is further of a size that enables it to be carried in a side pouch of a golf bag if desired and is obviously connectable to the golf club in a matter of seconds.

Although the present invention has been described with a certain degree of particularity, it is understood that the present disclosure has been made by way of example, and changes in detail or structure may be made without departing from the spirit of the invention, as defined in the appended claims.

I claim:

1. A grip extender for extending the length of a golf club to form a chip shot training club, said golf club including an elongated hollow tube handle defining a central axial aperture at a free end thereof opening into the interior of said tube along the central longitudinal axis of the tube, said grip extender comprising an elongated substantially hollow main body having a longitudinal axis, and an elongated rod mounted on and extending longitudinally axially from one end of said elongated main body, said rod being configured to define an initial straight length of rod and a subsequent plurality of reversing bends which are substantially symmetric relative to said central longitudinal axis, said rod being insertable into said aperture along the central longitudinal axis of the tube such that said bends engage said tube at a plurality of longitudinally spaced locations on different sides of said tube for positively supporting said grip extender on said golf club in continuous longitudinal axial alignment therewith, said grip extender main body having a plug-type connector at one end supporting said rod such that said rod extends from said main body along said central longitudinal axis of the tube when the extender is mounted on said golf club, said main body also having a length which extends upwardly from said free end of said handle along the golfer's arm to approximately, but not exceeding, the position of said golfer's elbow when the golfer is conventionally gripping said golf club.

* * * * *